US010533396B2

(12) United States Patent
McNeilly et al.

(10) Patent No.: US 10,533,396 B2
(45) Date of Patent: Jan. 14, 2020

(54) BALL VALVE AND REMOTELY RELEASABLE CONNECTOR FOR DRILL STRING

(71) Applicants: A. Keith McNeilly, Houma, LA (US); Michael Jenkins, Raceland, LA (US)

(72) Inventors: A. Keith McNeilly, Houma, LA (US); Michael Jenkins, Raceland, LA (US)

(73) Assignees: A. Keith McNeilly, Houma, LA (US); Michael Jenkins, Raceland, LA (US)

( * ) Notice: Subject to any disclaimer, the term of this patent is extended or adjusted under 35 U.S.C. 154(b) by 712 days.

(21) Appl. No.: 15/258,848

(22) Filed: Sep. 7, 2016

(65) Prior Publication Data

US 2017/0122070 A1 May 4, 2017

Related U.S. Application Data

(60) Provisional application No. 62/250,542, filed on Nov. 4, 2015.

(51) Int. Cl.
*E21B 34/10* (2006.01)
*E21B 34/14* (2006.01)
*E21B 34/00* (2006.01)

(52) U.S. Cl.
CPC ..... *E21B 34/101* (2013.01); *E21B 34/14* (2013.01); *E21B 2034/002* (2013.01)

(58) Field of Classification Search
CPC ..... E21B 2034/002; E21B 34/101; E21B 34/105; E21B 34/14
See application file for complete search history.

(56) References Cited

U.S. PATENT DOCUMENTS 3,870,101 A * 3/1975 Helmus ..... E21B 29/04 166/322
3,967,647 A * 7/1976 Young ..... E21B 29/04 137/614.11
4,074,761 A * 2/1978 Mott ..... E21B 21/10 137/496
4,550,780 A * 11/1985 Mott ..... E21B 34/102 166/321
5,193,619 A * 3/1993 Edwards ..... E21B 34/103 166/321
2005/0051342 A1* 3/2005 Campbell ..... E21B 43/10 166/380

(Continued)

*Primary Examiner* — Daniel P Stephenson
(74) *Attorney, Agent, or Firm* — Bracewell LLP; James E. Bradley

(57) ABSTRACT

A connector has an upper end for connection into the upper part of a drill string. The connector has an outer member that slides over an inner member, the outer member and the inner member having a locked position and an unlocked position. A latch assembly in the connector places the inner member and the outer member in the unlocked position in response to hydraulic fluid pressure applied to the connector. A ball valve assembly has an upper portion for connection with a lower end of the connector and a lower portion for connection into a lower part of the drill string. A ball valve element actuator in the ball valve assembly rotates a ball valve element to the closed position in response to the upper portion of the ball valve assembly moving downward relative to the lower portion of the ball valve assembly.

19 Claims, 11 Drawing Sheets

(56) References Cited

U.S. PATENT DOCUMENTS

| | | | | |
|---|---|---|---|---|
| 2014/0196912 | A1* | 7/2014 | Turley | E21B 43/10 166/382 |
| 2017/0122070 | A1* | 5/2017 | McNeilly | E21B 34/101 |
| 2018/0223615 | A1* | 8/2018 | Luke | E21B 33/04 |

* cited by examiner

BALL VALVE AND REMOTELY RELEASABLE CONNECTOR FOR DRILL STRING

1. CROSS REFERENCE TO RELATED APPLICATION

This application claims priority to provisional application 62/250,542, filed Nov. 4, 2015.

2. FIELD OF THE DISCLOSURE

This application relates to downhole oil and gas well drilling equipment and in particular to a drill string ball valve and releasable connector for temporarily storing the drill string in a well.

3. BACKGROUND

Various types of valves are used to shut off and isolate a bore hole of a well from communication with the surface. Some of these valves are deployed to a depth within a bore hole and are used to shut off the well bore at the desired depth.

There are many reasons when it may become necessary to shut off a well bore below the surface. As an example, it may become desirable to close off the bore hole of an offshore well in the event of an approaching storm so as to allow personnel to evacuate. It may become desirable to perform maintenance on surface well control equipment.

Deployment of a below surface valve is desirable because most of the drill pipe being actively utilized can be left within the well bore and hung off while the drill pipe above the valve is retrieved. Once the upper part of the drill string has been retrieved, the surface well control equipment may be completely closed. This procedure expedites the time required to prepare for an evacuation because all of the drill pipe does not have to be pulled from the well bore.

Previously, deploying a downhole valve is accomplished by retrieving at least part of the drill string, then securing an anchoring device such as a packer to the upper end of the portion of the drill string still in the bore hole. The valve is secured to the upper end of the anchoring device, and a connector secures to the upper end of the valve. The operator attaches a running string or upper string to the connector and lowers the assembly to a desired depth in the well with the valve open to allow fluid to enter the upper string. Once at the desired depth, the anchoring device is activated, usually by rotation, to grip and seal to casing in the bore hole. Once the anchor is set, the operator slacks off, which transfers the weight of the drill pipe to slips of the anchor and to the casing.

At this point, the valve is normally still open and requires further manipulation to be closed. As an example, the upper string may be rotated to close the valve as well as disconnect the connector from the valve. The upper string may then be retrieved.

4. SUMMARY

A deploying apparatus mounts between an upper string and a lower string of drill pipe to retrieve the upper string after an anchor in the lower string has been set and to block any upward flow of fluid through the lower string after the upper string has been retrieved. A connector has a threaded upper end for connection into the upper string. The connector has an outer member that slides over an inner member. The outer member and the inner member have a locked position that transfers tension through the connector to enable the upper and lower strings to be run into the well. The outer member and the inner member have an unlocked position that allows the outer member and the inner member to be released from each other to retrieve the upper string from the lower string after the anchor has been set. A latch assembly in the connector positions the inner member and the outer member in the unlocked position in response to hydraulic fluid pressure applied to the connector.

A ball valve assembly has an upper portion with a threaded upper end for connection with a lower end of the connector and a lower portion with a threaded lower end for connection with the lower string. A ball valve element in the ball valve assembly has an open position allowing fluid flow through the lower string and a closed position blocking flow through the lower string. A ball valve element actuator in the ball valve assembly rotates the ball valve to the closed position in response to the upper portion of the ball valve assembly moving downward relative to the lower portion of the ball valve assembly and rotates the ball valve to the open position in response to the upper portion of the ball valve assembly moving upward relative to the lower portion of the ball valve assembly.

The outer member and the inner member are movable to the unlocked position without requiring any rotation of the upper end of the connector relative to the lower end of the connector.

The connector has an axial passage extending through the outer member and the inner member to receive fluid pumped down the upper string. The latch assembly has a latch piston carried within a latch chamber. A connector port extends from the axial passage to the latch chamber to apply fluid pressure to the latch piston in response to the fluid being pumped down the upper string to positon the latch assembly in the unlocked position.

The outer member and the inner member of the connector are movable from an extended position during run-in to a contracted position after the anchor has been set. The latch assembly enables movement from the locked position to the unlocked position only while the outer member and the inner member of the connector are in the contracted position.

A set of emergency release threads between the outer member and the inner member enable the outer member and the inner member to be released from each other in response to rotation of the upper end of the connector relative to the lower end of the connector. A torque transfer lug enables rotation of the upper end of the connector relative to the lower end of the connector while the inner member and the outer member are in the contracted position.

Upper and lower seats sandwich the ball valve element. An upper floating piston above the upper seat urges an upper mandrel downward in response to fluid pressure in the ball assembly above the ball element. A lower floating piston below the lower seat urges a lower mandrel upward in response to fluid pressure in the ball assembly below the ball element. An upper exterior port in the ball valve assembly below the upper floating piston moves the upper floating piston upward relative to the upper seat in response to external fluid pressure applied to the ball valve assembly. A lower exterior port in the ball valve assembly above the lower floating piston moves the lower floating piston downward relative to the upper seat in response to external fluid pressure applied to the ball valve assembly.

A lower equalizing port extends from the flow passage below the lower valve seat to an exterior portion of the lower valve seat, bypassing an interface between the ball element and the lower valve seat. An upper equalizing port extends from an exterior portion of the upper valve seat to the flow passage above the upper valve seat, bypassing an interface between the ball element and the upper valve seat. The upper equalizing port opens while the upper portion of the ball valve assembly moves upward relative to the lower portion of the ball valve assembly to equalize pressure in the flow passage below the ball element with above the ball element while the ball element is in the closed position prior to moving the ball element to the open position. The upper equalizing port closes while the upper portion of the ball valve assembly moves downward relative to the lower portion of the ball valve assembly.

A threaded seat adjusting ring may be employed in engagement with one of the seats for moving said one of the seats adjustably toward and away from the other of the seats in response to selected rotation of the seat adjusting ring.

A cam assembly in engagement with the ball element makes an axial stroke to change between the closed and the open positions. The cam assembly may include a threaded cam member adjusting ring that positions a length of the stroke of the cam assembly in response to selected rotation of the cam member adjusting ring.

5. BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

Figure 1:
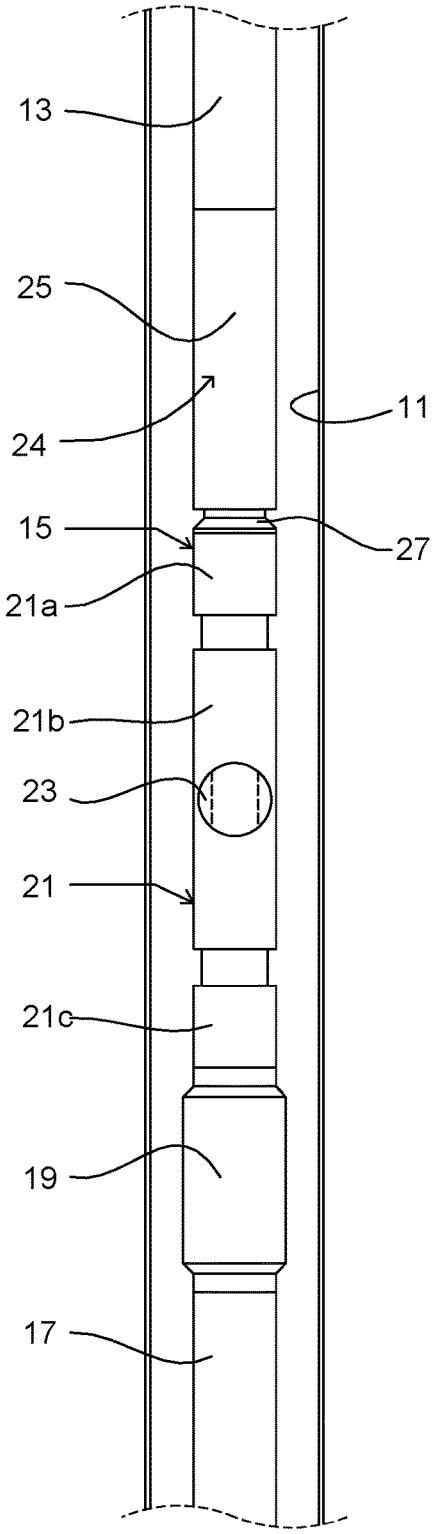
FIG. 1 is a schematic view illustrating a ball valve, releasable connector and packer assembly installed in a drill string and being lowered into a well.
Figures 4A, 4B:
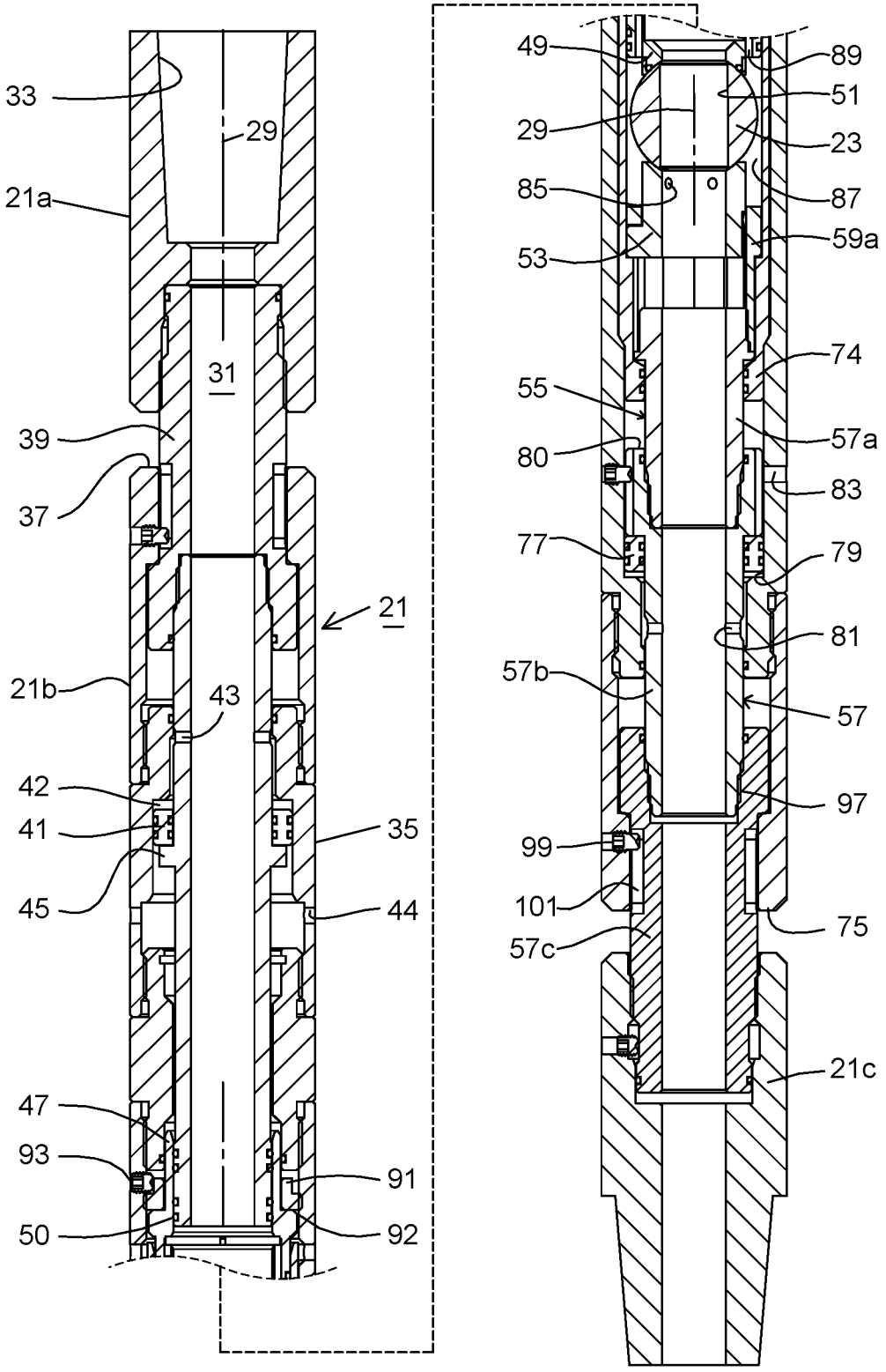

FIGS. 4A and 4B comprise a sectional view of the ball valve of FIG. 1, shown in an open, run-in position and separate from the connector and drill string of FIG. 1.

Figure 5:
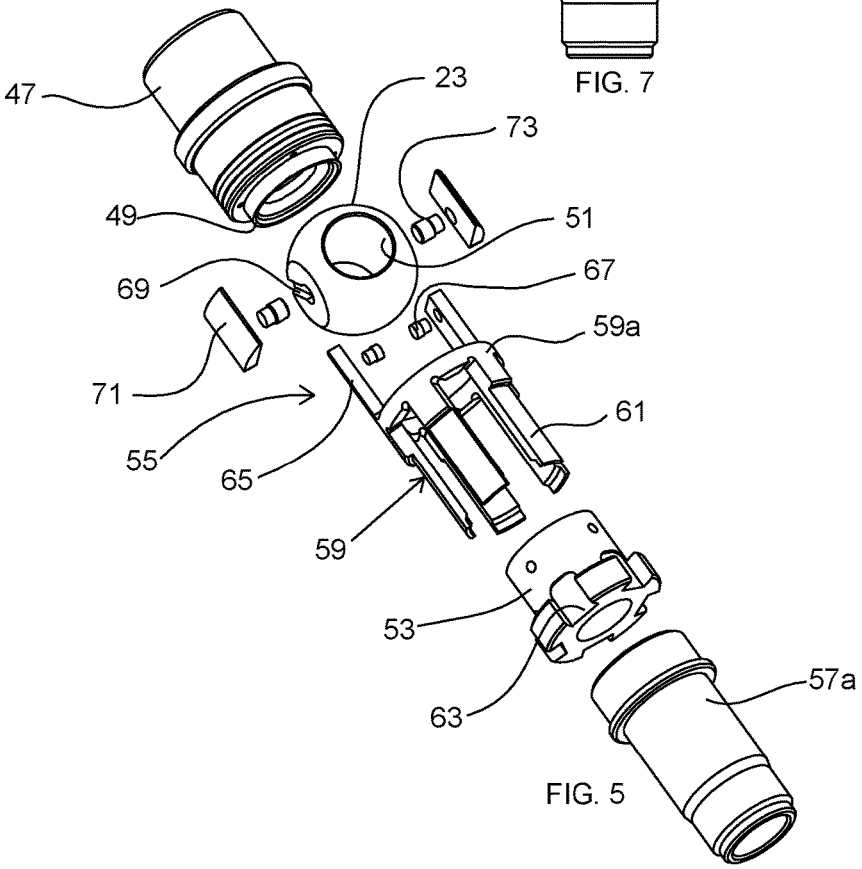

FIG. 5 is an exploded view of a ball element subassembly of the ball valve of FIGS. 4A and 4B.

Figure 6:
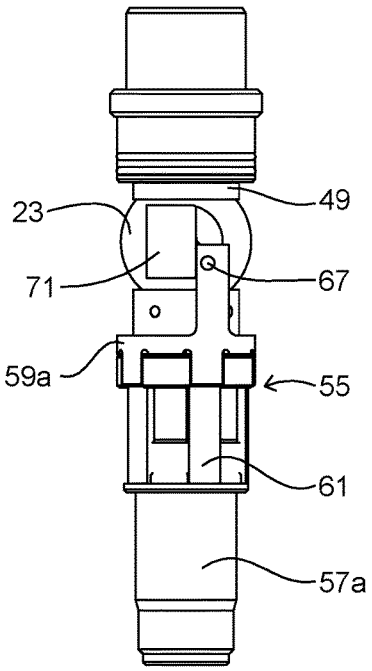

FIG. 6 is a side view of the ball element subassembly of the ball valve of FIG. 5, showing the ball element in an open position.

Figure 7:
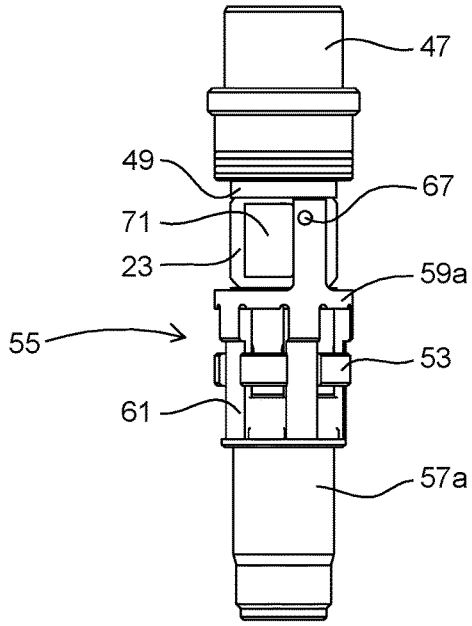

FIG. 7 is a side view of the ball element subassembly of FIG. 6, showing the ball element in a closed position.

Figures 8A, 8B:
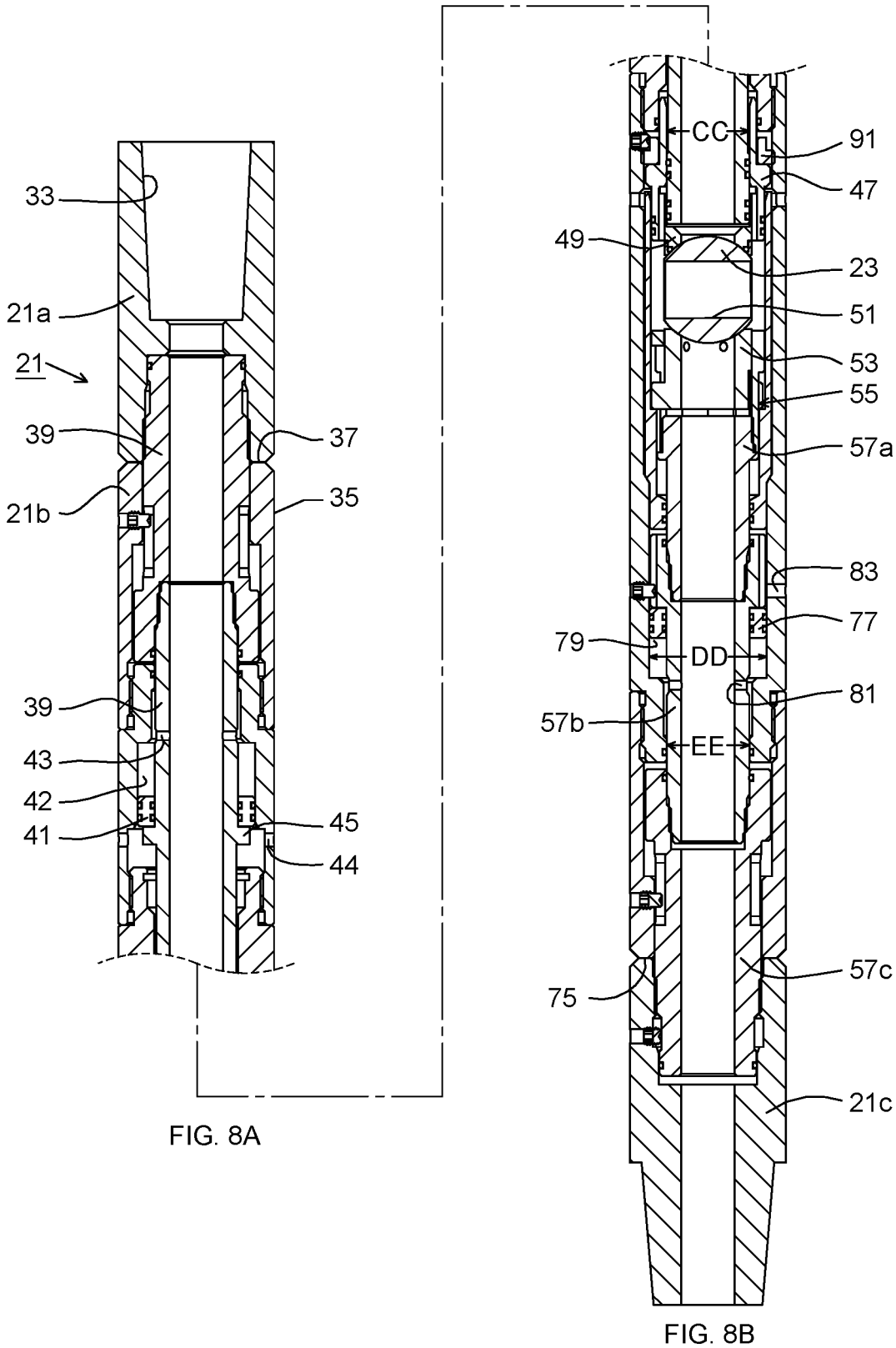

FIGS. 8A and 8B comprise a sectional view of the ball valve of FIGS. 4A and 4B, but showing the ball valve and equalizing feature in a closed position.

Figure 9:
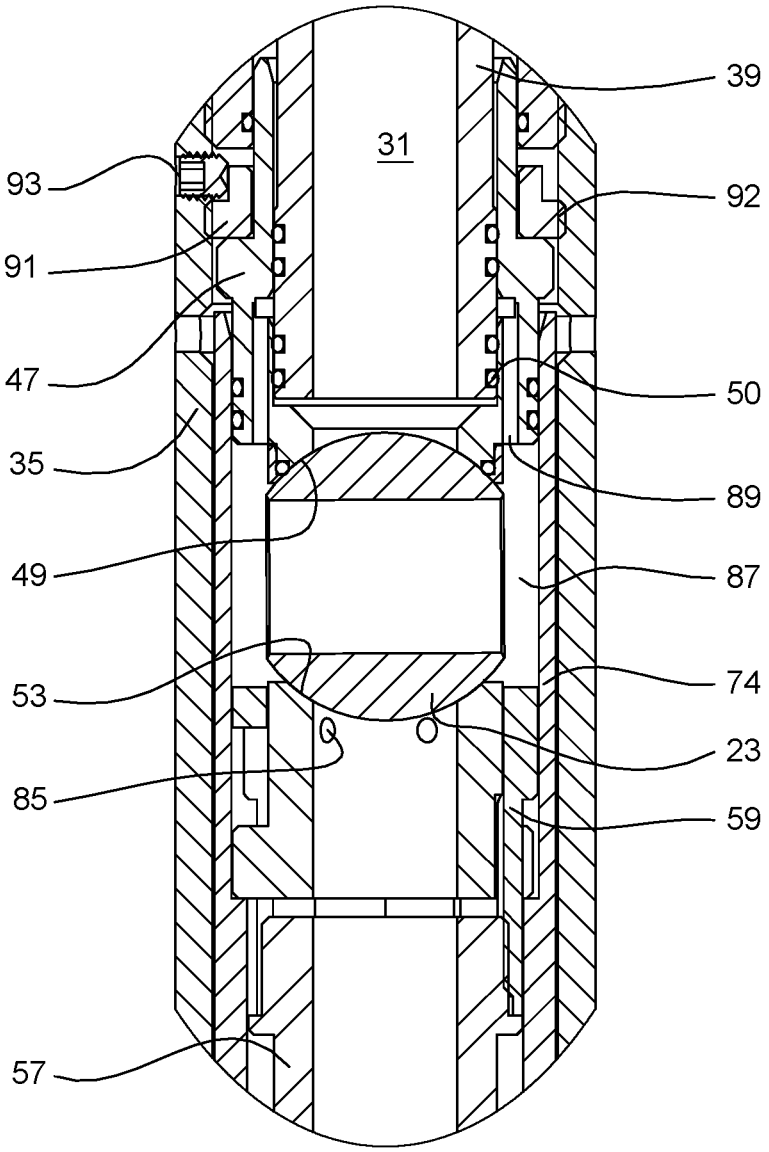

FIG. 9 is an enlarged sectional view of part of the ball valve shown in FIG. 8B.

Figure 10:
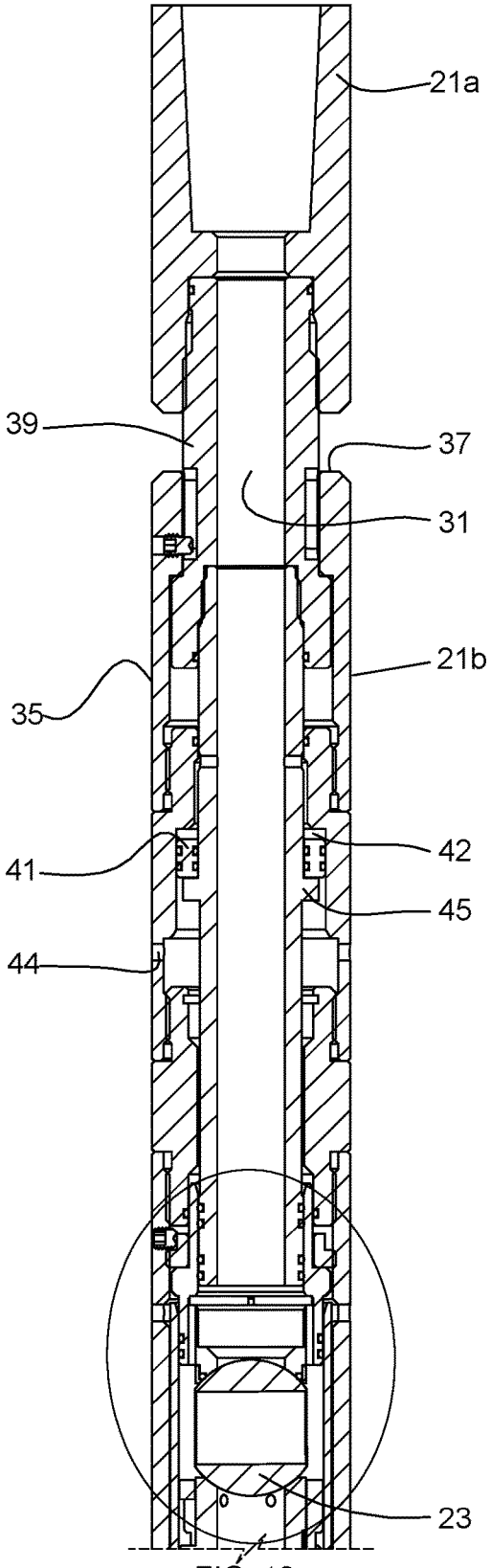

FIG. 10 is a sectional view of part of the ball valve of FIGS. 8A and 8B, but showing an upper part of the ball valve being lifted to open the equalizing feature prior to opening the ball valve.

Figure 11:
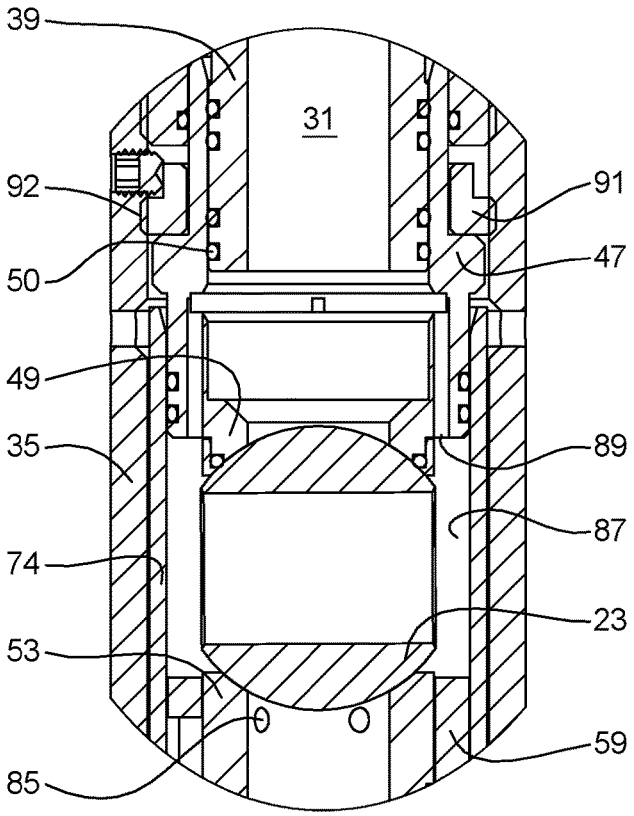

FIG. 11 is an enlarged portion of the ball valve of FIG. 10.

Figure 12A:
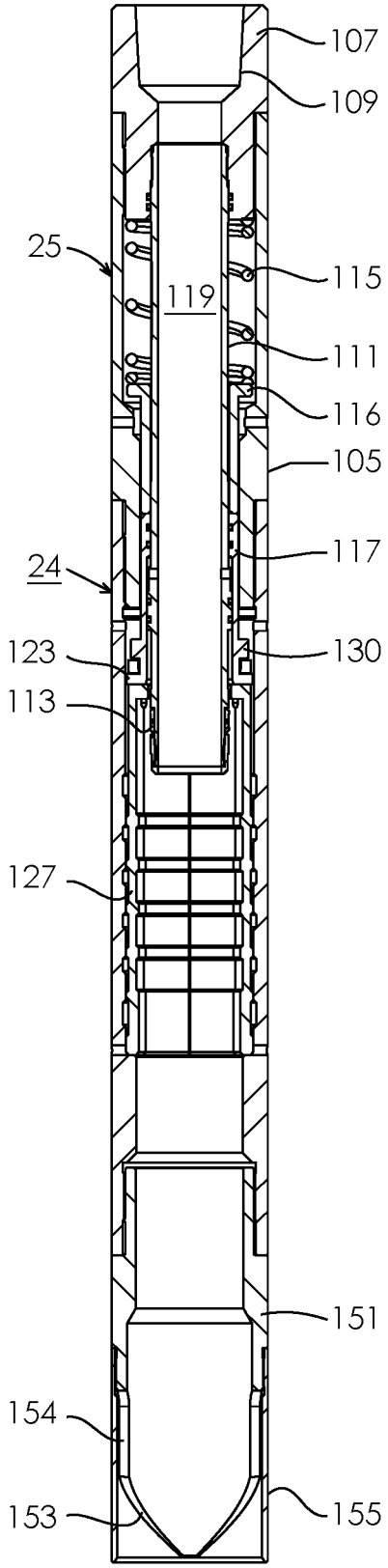
Figure 12B:
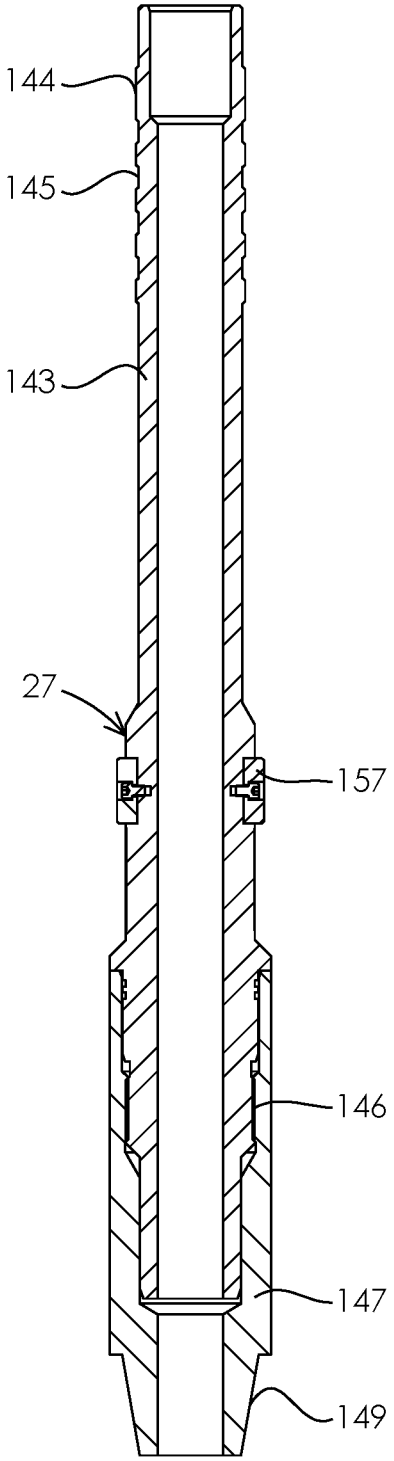

FIGS. 12A and 12B comprise a view of the connector of FIG. 1 separate from the ball valve and drill string, and with the overshot portion of the connector disengaged from the fishing neck part of the connector.

Figure 13:
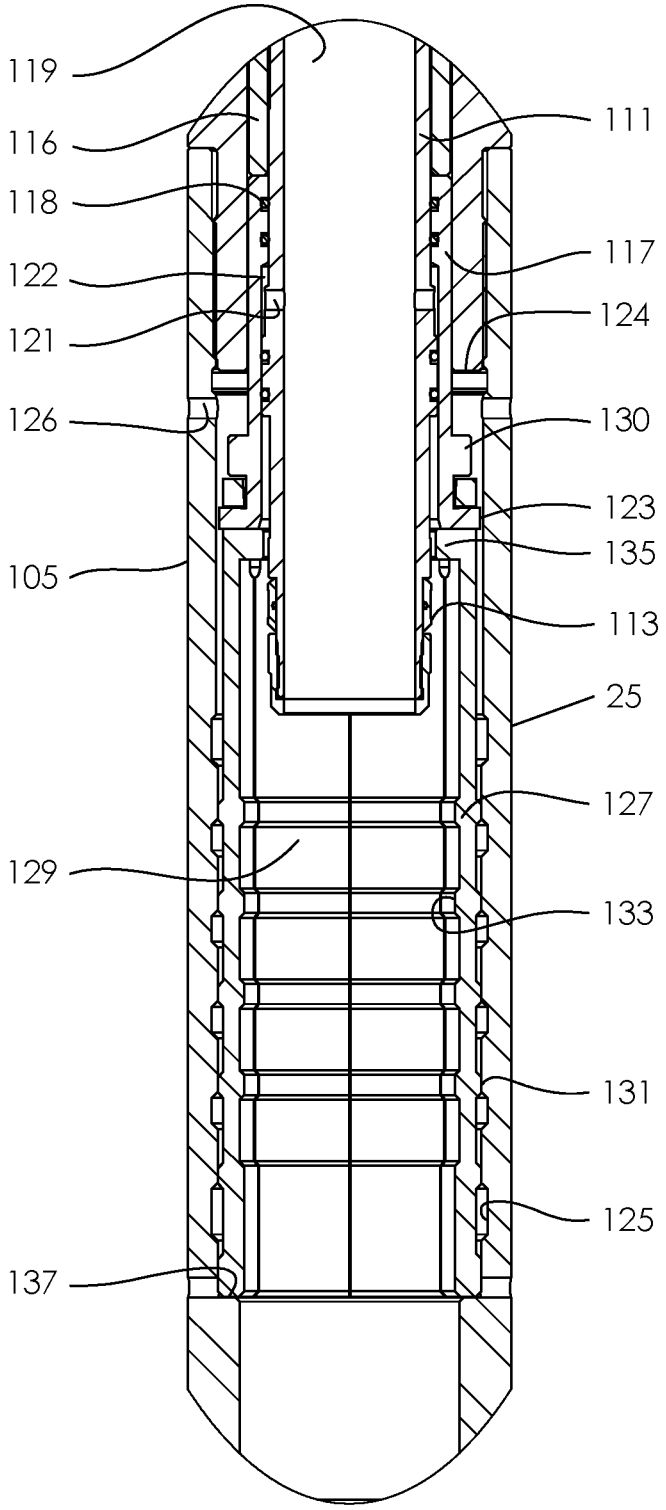

FIG. 13 is an enlarged sectional view of the part of the connector encircled in FIG. 12A.

Figure 14:
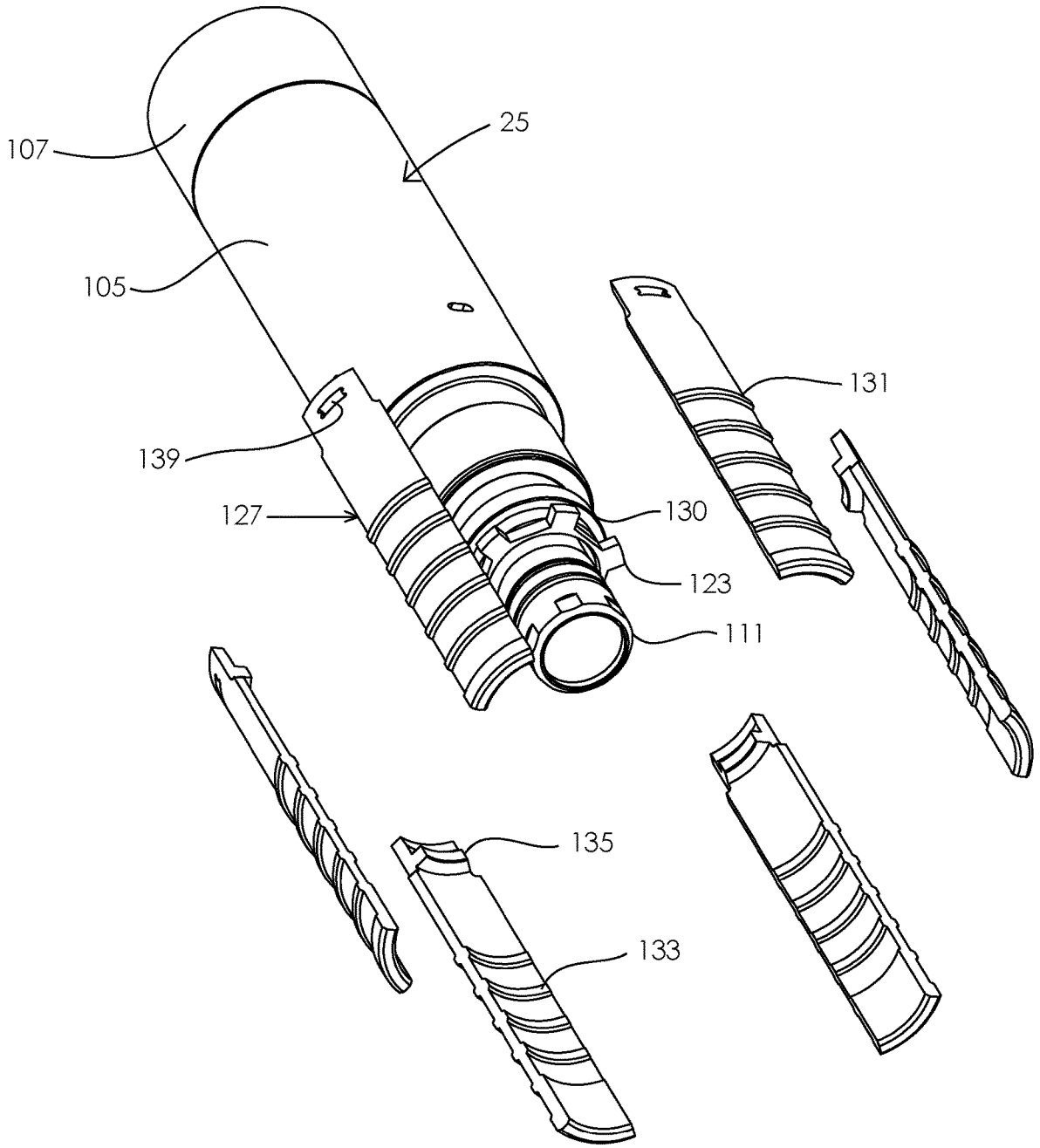

FIG. 14 is an exploded view of the part of the overshot of the connector of FIG. 13 and shown separate from the fishing neck.

Figure 15:
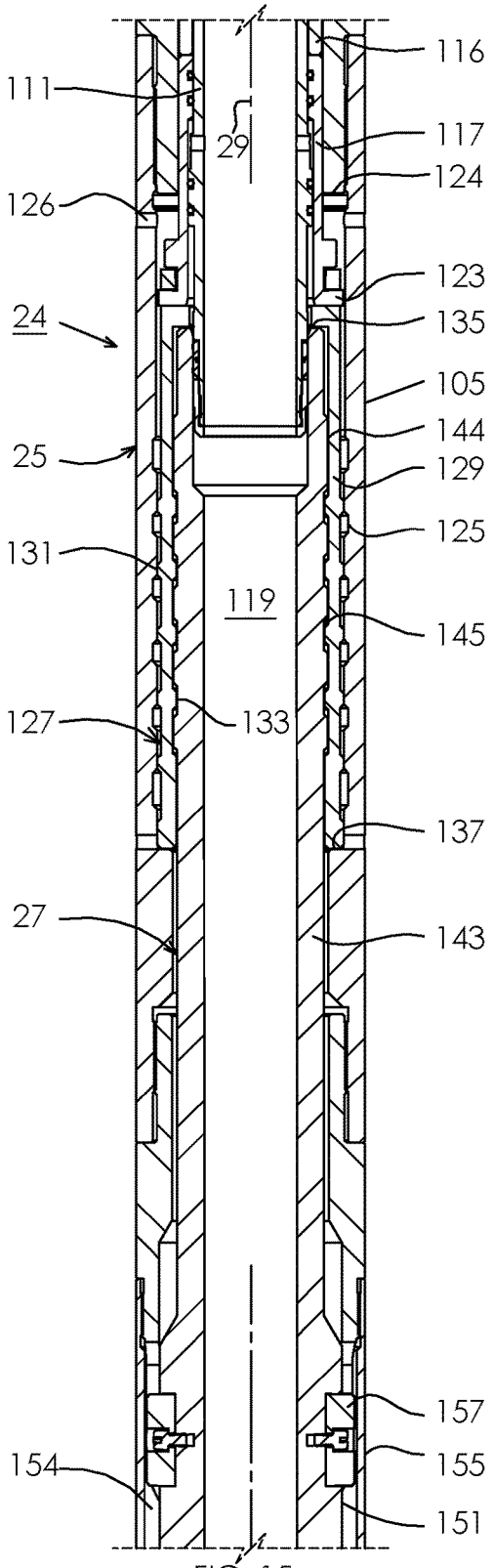

FIG. 15 is a sectional view the connector of FIGS. 12A and 12B, showing the connector in the run-in position of FIG. 1.

Figure 2:
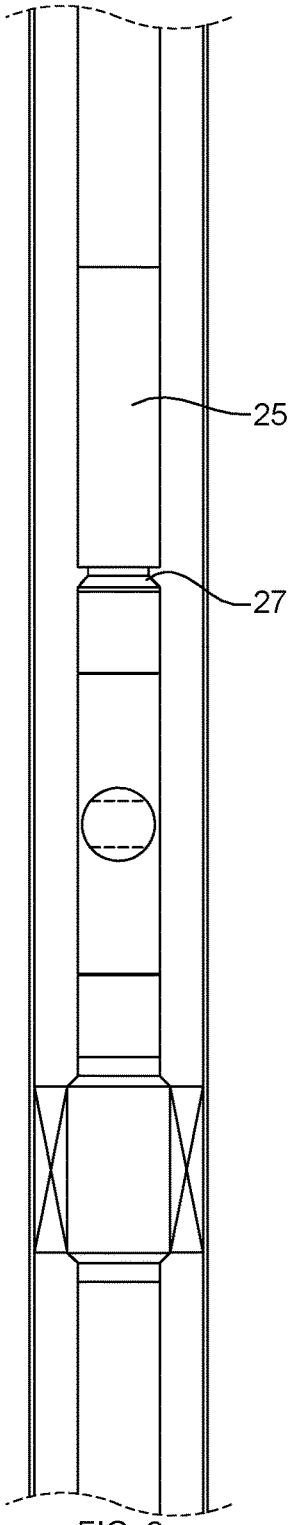
FIG. 2 is a schematic view of the assembly of FIG. 1 in a set position, with the packer set and the ball valve closed.
Figure 16:
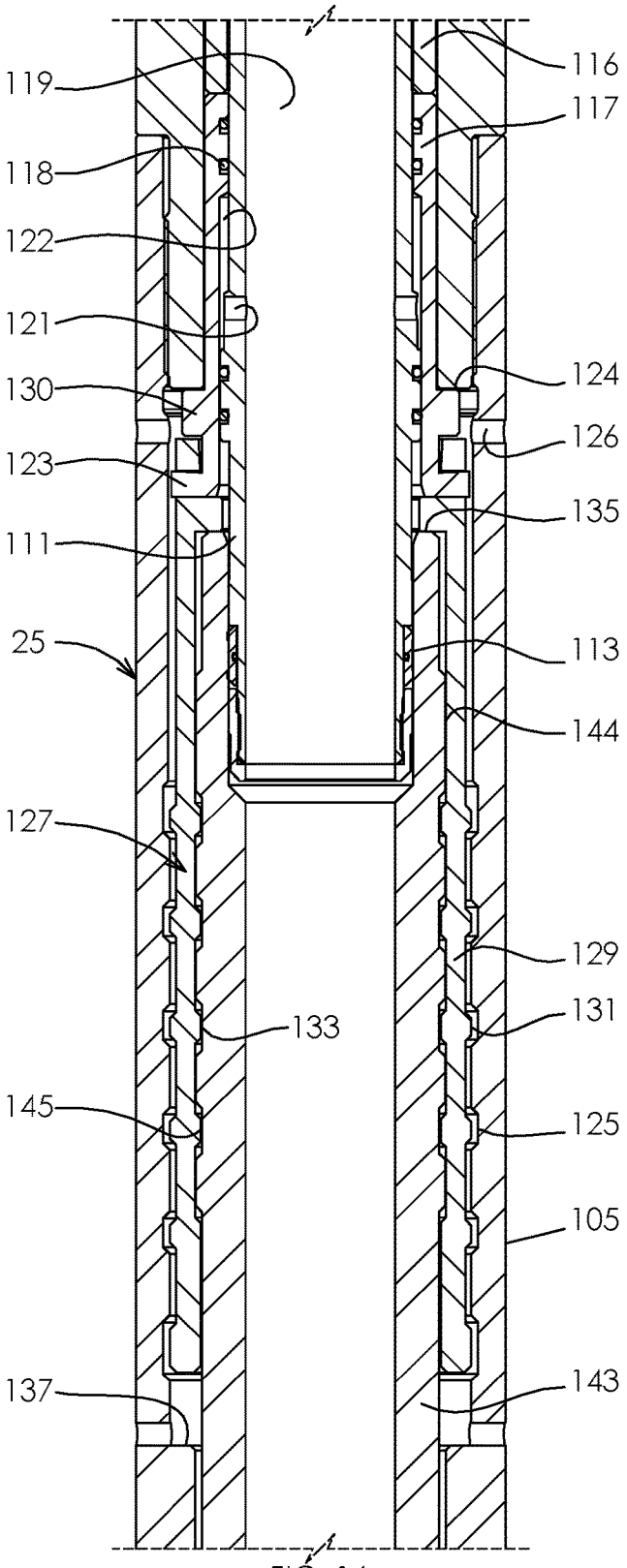

FIG. 16 is a sectional view of the connector of FIG. 15, showing the overshot lowered relative to the fishing neck after the packer is set in FIG. 2 prior to hydraulic fluid pressure being applied to release the overshot from the fishing neck.

Figure 17:
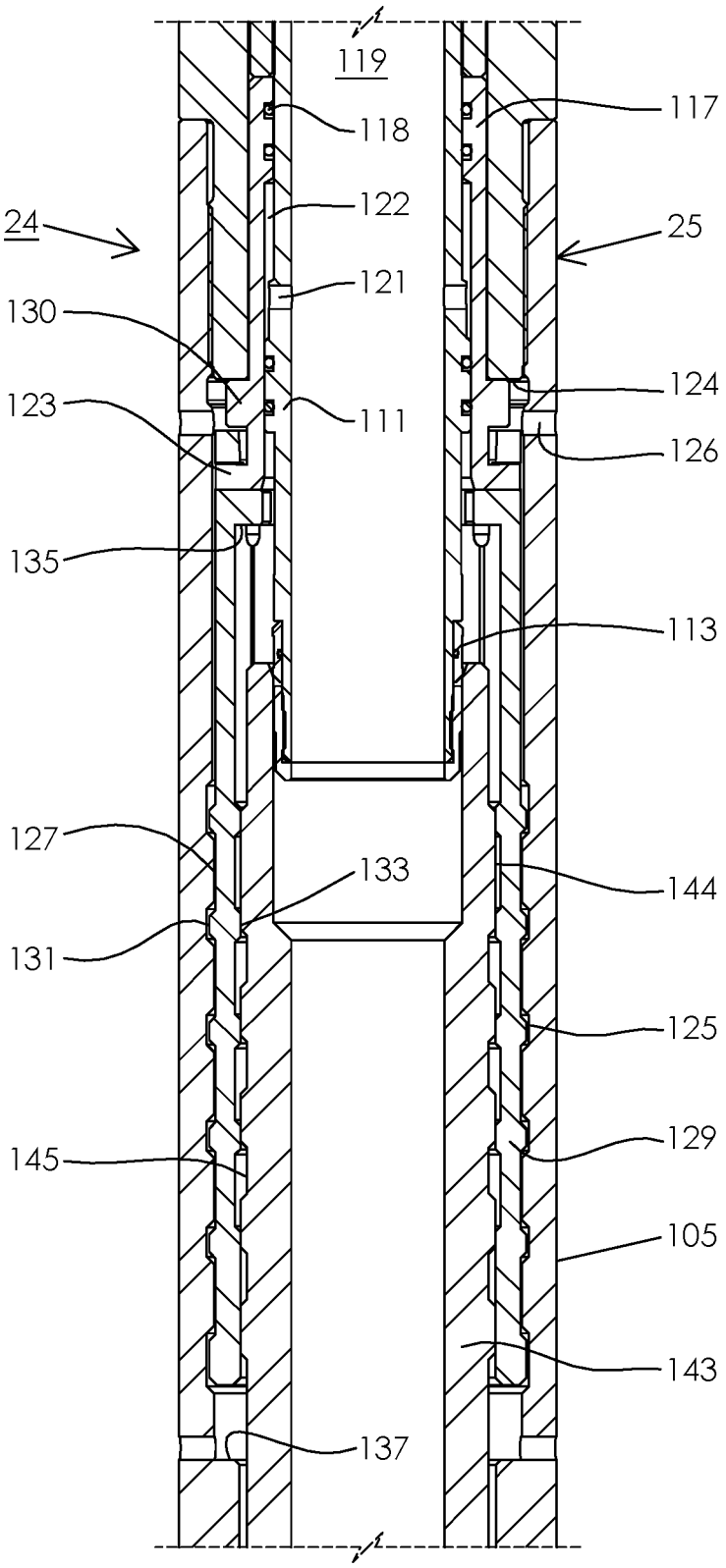

FIG. 17 is a sectional view of the connector of FIG. 16, showing hydraulic fluid pressure being applied and the overshot being lifted from the fishing neck.

6. DETAILED DESCRIPTION

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

Referring to FIG. 1, a well has casing 11 in which an operator from an offshore platform has lowered an upper or running string 13 of pipe, normally drill pipe. A deploying assembly 15 connects the lower end of upper string 13 to a lower string 17 of pipe. Deploying assembly 15 allows the operator to store lower string 17 temporarily while retrieving upper string 13. One reason might be to allow evacuation of personnel on the platform due to an approaching storm.

Figure 3:
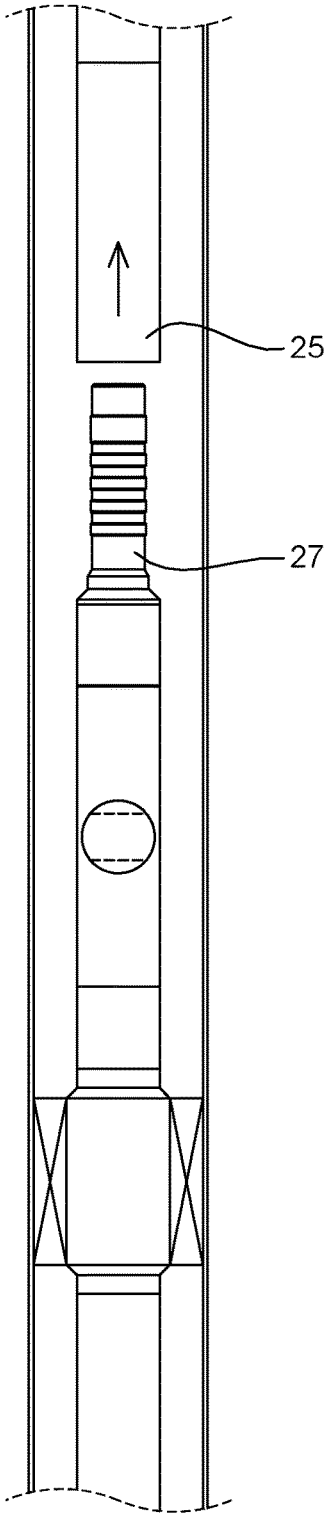
FIG. 3 is a schematic view of the assembly of FIG. 1, showing the connector released and being retrieved.

Deploying assembly 15 includes an anchor mechanism, typically a conventional packer 19. When set, packer 19 has an annular elastomeric element that seals to casing 11 and slips that frictionally engage casing 11 to support the weight of lower string 17 while it is being stored. Packer 19 may be set in various ways, such as by rotating upper string 13. FIGS. 2 and 3 schematically illustrate packer 19 in the set position.

Deploying assembly 15 includes a ball valve assembly 21 that has a ball valve element 23 that has an open position, as shown in FIG. 1, and a closed position, shown in FIGS. 2 and 3. Ball valve assembly 21 has three sections or portions, including an upper portion 21*a*, an intermediate portion 21*b*, and a lower portion 21*c*. Upper portion 21*a* is axially movable relative to intermediate portion 21*b*, and intermediate portion 21*b* is axially movable relative to lower portion 21*c*. FIG. 1 shows ball valve assembly 21 in an extended position, and FIG. 2 shows ball valve assembly 21 in a contracted position. The contracted position occurs due to lowering upper string 13 an increment after packer 19 has been set.

Deploying assembly 15 also includes a connector 24 that releasably connects ball valve assembly 21 to upper string 13. As shown in FIG. 3, connector 24 has an outer member or overshot 25 that releasably fits over and latches to an inner member 27. Connector 24 also has an extended position during run-in and a contracted position that occurs due to lowering upper string 13 an increment after packer 19 has been set.

To deploy lower string 17, the operator attaches deploying assembly 15 while the upper end of lower string 17 is at the rig floor, then makes up upper string 13 while lowering the deploying assembly 15 and lower string 17 to a desired depth in casing 11. Ball valve 23 will be in the open position, allowing fluid to flow through deploying assembly 15. The operator then sets packer 19 as shown in FIG. 2.

After packer 19 has been set, the operator slacks off the weight on upper string 13, which causes it to move downward a short distance relative to lower string 17. Ball valve assembly intermediate portion 21*b* moves downward with upper string 13 and abuts lower portion 21*c*. As will be explained subsequently, this downward relative movement causes ball valve element 23 to rotate to the closed position shown in FIGS. 2 and 3. While in the closed position, it will not be possible for well fluid below lower string 17 to flow upward past ball valve element 23. Continued downward movement of upper string 13 after ball valve element 23 closes also causes upper portion 21*a* to move downward relative to intermediate portion 21*b*. Additionally, lowering upper string 13 after packer 19 has been set also causes connector overshot 25 to move downward an increment relative to connector inner member 27.

The operator then pumps fluid down the interior of upper string 13, which places overshot 25 and fishing neck 27 in a released position. The operator then retrieves upper string 13, as indicated in FIG. 3, leaving lower string 17, ball valve assembly 21, and inner member 27 in casing 11. At a later date, the operator runs upper string 13 and overshot 25 back in and latches overshot 25 to fishing neck 27. The operator then begins to lift upper string 13, which will first cause ball valve assembly upper portion 21*a* to move upward relative to intermediate portion 21*b*. This upward movement causes equalizing ports, explained later, to open and equalize any pressure below ball valve element 23 with pressure above. Then continued upward movement causes ball valve intermediate portion 21*b* to move upward relative to lower portion 21*c*, which rotates ball valve element 23 to the open position. The operator may then release packer 19 and retrieve deploying assembly 15 and lower string 17.

Referring to FIG. 4A, ball valve assembly 21 has a longitudinal axis 29 and a flow passage 31 extending axially through it. Ball valve assembly upper portion 21*a* is an adapter having threads 33, which may be internal, as shown, or external, for connecting to connector 24 (FIG. 1). Ball valve assembly intermediate portion 21*b* has a housing 35 that may be in several parts, as shown, connected by threads. While in the contracted position, the lower end of upper portion 21*a* abuts an upper shoulder 37 on housing 35. An upper mandrel 39 secures by threads to and extends downward from upper portion 21*a* into housing 35. Upper mandrel 39 may be in more than one piece, as shown.

In this embodiment, an upper floating piston 41 encircles upper mandrel 39. Upper floating piston 41 seals and moves axially relative to upper mandrel 39 and the inner side wall of a chamber 42 in housing 35. An upper internal port 43 in the side wall of mandrel 39 above upper floating piston 41 communicates fluid pressure in flow passage 31 with chamber 42 and the upper side of upper floating piston 41. An upper external port 44 in the side wall of housing 35 below upper floating piston 41 communicates fluid pressure on the exterior of housing 35 to the lower side of upper floating piston 41. The lower side of upper floating piston 41 will abut a shoulder 45 on upper mandrel 39 while upper floating piston 41 is in a lower position relative to upper mandrel 39. The function of upper floating piston 41 will be explained subsequently.

An upper seat sleeve 47 joins and extends upward into housing 35 from an upper ball seat 49 (FIG. 4B). Seals 50 on the lower end of upper mandrel 39 seal to the inner surface of upper seat sleeve 47. While ball valve assembly 21 is in the extended position of FIGS. 4A, 4B and 11, the lower end of upper mandrel 39 will be spaced above an upper side of upper ball seat 49. While ball valve assembly 21 is in the retracted position of FIGS. 8A, 8B and 9, the lower end of upper mandrel 39 will be in abutment with the upper side of upper ball seat 49.

Referring to FIG. 4B, ball element 23 has a passage 51 through it that is coaxial while in the open position and perpendicular to axis 29 while in the closed position. A lower ball seat 53 seals against a lower side of ball element 23 while upper ball seat 49 seals against the upper side while in the closed position.

An actuator 55 moves ball element 23 from the open position to the closed position in response to intermediate portion 21*b* moving downward relative to lower portion 21*c*. Referring also to FIG. 5, actuator 55 includes a ball mandrel 57 located below lower seat 53. Ball mandrel 57 may be formed in segments 57*a*, 57*b* and 57*c* secured together by threads, with the lowermost segment 57*c* secured by threads in ball valve assembly lower portion 21*c*. Housing 35 and ball seats 47, 53 move upward and downward in unison with housing 35 relative to ball mandrel 57 while moving from extended to contracted positions.

A cam member 59 has an annular portion 59*a* that encircles part of lower seat 53 and engages an upper end of ball mandrel 57. Cam member 59 has circumferentially spaced apart segments 61 that extend downward from annular portion 59*b* through circumferentially spaced slots 63 on the exterior of lower seat 53. The lower ends of cam member segments 61 engage a shoulder on ball mandrel segment 57*a*. Cam member 59 has two arms 65 that extend upward from annular portion 59*a* on opposite flat sides of ball element 23. Cam pins 67 in arms 65 engages grooves 69 on each flat side of ball element 23. Centralizers 71 provide support to ball element 23 via axle pins 73 extending into each flat side. A ball housing 74 shown in FIG. 4B but not in FIGS. 5-7, is fixed on a shoulder in housing 35.

Referring also to FIG. 4B, during closing, housing 35, lower seat 53, ball element 23 and ball housing 74 move downward while cam member 59 and ball mandrel 57 remain axially fixed in position relative to lower portion 21*b*. The downward relative movement causes cam pins 67 to rotate ball element 23 from its open to its closed position. This downward movement occurs when housing 35 of intermediate portion 21*b* moves from the extended to the contracted position relative to lower portion 21*c*. Similarly, lifting housing 35 relative to lower portion 21*b* causes lower seat 53, ball element 23 and ball housing 74 to move upward relative to cam member 59 and ball mandrel 57, opening ball element 23. FIG. 7 shows actuator 55 and ball element 23 in a closed position, and FIG. 6 shows them in an open position.

Referring still to FIG. 4B, housing 35 has a shoulder 75 on its lower end that abuts the upper end of ball valve assembly lower portion 21*c* while in the retracted position. Ball mandrel segment 57*c* extends below housing 35.

A lower floating piston 77 moves within an annular lower floating chamber 79 in housing 35 below lower seat 53. While in an upper position, lower floating piston 77 abuts the lower side of an external flange 80 on ball mandrel segment 57*b*. A lower piston internal port 81 extends from the portion of flow passage 31 in mandrel segment 57*b* to the lower side of lower floating piston 77 in chamber 79. A lower piston external port 83 extends through the side wall of housing 35, communicating well fluid pressure on the exterior of housing 35 with the upper side of lower floating piston 77.

Upper floating piston 41 and lower floating piston 77 serve to remove a pressure differential that might tend to cause ball valve element 23 to open from a closed position. Referring to FIGS. 8A and 8B, which show ball valve element 23 closed, if the internal fluid pressure in flow passage 31 is greater than the external fluid pressure surrounding housing 35, the internal pressure in flow passage 31 acts via internal port 43 on the upper side of upper floating piston 41. This pressure causes upper floating piston 41 to be in a lower position, pushing downward on upper mandrel 39. The downward force is based on the pressure area BB of upper floating piston chamber 42. This pressure area is greater than pressure area CC, which is the area of upper mandrel seals 50. A force due to internal pressure in flow passage 31 trying to push upper mandrel 39 upward would be based on pressure area CC, thus it would be less than the downward force.

Similarly, pressure in flow passage 31 acts on the lower side of lower floating piston 77 via internal port 81. Lower floating piston 77 pushes upward on ball mandrel 57. The upward force is based on the pressure area DD of lower piston chamber 79. A force tending to push housing 35 upward relative to mandrel 57 is based on the pressure area EE at the lower end of lower piston chamber 79. Pressure area EE is less than pressure area DD, resulting in a net upward force.

External fluid pressure on the exterior of housing 35 greater than internal pressure in flow passage 31 acts on the lower side of upper floating piston 41 via external port 44. This pressure would push upper floating piston 41 to the upper end of upper floating piston chamber 42. While in the upper position, upper floating piston 41 will exert no force, either upward or downward on upper seat 49. Similarly, external fluid pressure on the exterior of housing 35 greater than internal pressure in flow passage 31 acts via external port 83 on the upper side of lower floating piston 77. This pressure would push lower floating piston 77 downward to the lower end of lower floating piston chamber 79. While lower floating piston 77 is in the lower position, it will exert no force, either downward or upward on lower seat 53.

Referring to FIGS. 9 and 11, ball valve assembly 21 has a pressure equalizing feature to reduce any pressure differential on ball element 23 while it is being moved from the closed to the open position. A lower equalizing port 85 extends from the portion of flow passage 31 within lower seat 53 to a ball chamber 87 extending around ball element 23. An upper equalizing port 89 extends through upper seat 49 from ball chamber 87 into the inner diameter of upper ball seat sleeve 47. While in the closed position, seals 50 on the lower end of upper mandrel 39 will block upper equalizing port 89, as shown in FIG. 9. Thus any internal pressure in flow passage 31 below ball element 23 will not be able to communicate upward past ball element 23.

When starting to open ball element 23, the operator will pull upward on ball valve assembly 21, which initially causes upper portion 21*a* to move upward from the retracted position of FIGS. 8A and 8B and 9. Upper portion 21*a* moves upward relative to intermediate portion housing 35, which causes upper mandrel 39 to move upward relative to upper ball seat sleeve 47 and upper seat 53, as shown in FIGS. 10 and 11. Upper mandrel seals 50 move above where upper equalizing port 89 enters the inner diameter of upper seat sleeve 47. As shown by the dotted lines in FIG. 11, this movement opens upper equalizing port 89, allowing fluid pressure from below ball element 23 to bypass the interface between closed ball element 23 and lower seat 53 to equalize the pressure above ball element 23 with that below. With the pressure differential reduced, the frictional force to rotate ball element 23 reduces. Continued upward movement of ball valve assembly upper portion 21*a* causes intermediate portion housing 35 to move upward relative to ball valve assembly lower portion 21*c*. That relative movement will cause actuator 55 to rotate ball valve element 23 to the open position.

Referring back to FIG. 4A, ball valve assembly 21 has an adjustment feature to adjust the precise tension between upper and lower seats 49, 53. In this example, a threaded upper seat adjusting ring 91 has external threads that engage mating threads 92 in housing 35 Seat adjusting ring 91 engages an upward facing shoulder on upper ball seat sleeve 47. Rotating seat adjusting ring 91 in one direction moves adjusting ring 91 downward, increasing frictional contact. Rotating seat adjusting ring 91 in the opposite direction decreasing frictional contact. A set screw 93 extending through a threaded hole in housing 35 will prevent any rotation of seat adjusting ring 91 once set in the desired position.

Referring to FIG. 4B, ball valve assembly 21 also has a stroke adjustment feature to assure that ball element 23 is in the desired position with its passage 51 perpendicular to axis 29 while closed. This adjustment feature adjusts the length of the stroke of actuator 55 between the open and closed positions. The adjustment is performed by adjusting the amount of engagement of threads 97 between lower mandrel segment 57*c* and intermediate mandrel segment 57*b*. Once the desired stroke length is set, a set screw 99 will be tightened to hold the desired position. Set screw 99 extends through a threaded hole in housing 35 into an axially extending groove 101 on the exterior of lower mandrel segment 57*c*. Set screw 99 slides along groove 101 when housing 35 moves upward and downward relative to lower portion 21*c* and lower mandrel segment 57*c*.

Referring to FIG. 12A, overshot 25 of connector 24 has a housing 105 that may be formed in more than one piece as shown. In this example, an upper end or adapter 107 secures by external threads 109 to internal threads in the upper end of housing 105. Upper adapter 107 secures to the lower end of upper string 13 (FIG. 1). A mandrel 111 secures by threads to upper adapter 107 and extends downward in housing 105. Mandrel 111 has external seals 113 on its lower end. A coil spring 115 encircles mandrel 111 and is compressed between a lower end of upper adapter 107 and a spring sleeve 116. Mandrel 111 extends through spring sleeve 116. The lower end of spring sleeve 116 abuts an upper end of a latch piston 117, which is a sleeve-like member.

Latch piston 117 is located in an annular space between housing 105 and mandrel 111, and is axially movable relative to each. As shown in FIG. 13, latch piston 117 has seals 118 on its inner diameter that seal and slide against the exterior of mandrel 111. A flow passage 119 extends through mandrel 111. A latch piston port 121 extends through the side wall of mandrel 111 to an annular chamber 122 between mandrel 111 and latch piston 117. The upper end of annular chamber 122 is bounded by latch piston seals 118 and the lower end by mandrel seals 113. Applying fluid pressure to flow passage 119 causes latch piston 117 to move upward relative to mandrel 111 and housing 105.

Latch piston 117 has external lugs or shoulders 123 formed on its exterior below a downward facing shoulder 124 in the bore of housing 105. The bore of housing 105 has a number of parallel, annular grooves 125 below downward facing shoulder 124. Housing 105 has external ports 126 located a short distance below shoulder 124.

A latch assembly 127, located in the bore of housing 105, has a plurality of latch segments 129, as shown also in FIG. 14. Each latch segment 129 is part of a cylindrical member. Latch segments 129 have outer latch ribs 131 and inner latch ribs 133. Ribs 131, 133 are parallel circumferentially extending bands. Each rib 131 has the same or a slightly less axial dimension as one of the housing grooves 125 so that they can fit within housing grooves 125 while in a released position. Each latch segment 129 has an inward protruding flange 135 near its upper end. Housing 105 has an internal upward facing shoulder 137 that is positioned to be engaged by the lower ends of latch segments 129 while in a locked position, run-in position. As illustrated in FIG. 14, each latch segment 139 has a pocket or aperture 139 near its upper end for receiving one of the latch piston lugs 123. Latch segments 139 are able to swing or pivot inward and outward relative to axis 29.

Referring to FIG. 12B, inner member 27 includes a fish neck 143 having a number of fish neck grooves 145 on its exterior. Fish neck grooves 145 extend circumferentially around fish neck 143 and have similar dimensions and spacing to housing grooves 125 (FIG. 13), defining bands between them. A band 144 at the upper end of fish neck grooves 145 has a greater axial width than the bands located between fish neck grooves 145. Fish neck 143 secures by threads 146 to a lower adapter 147. Lower adapter 147 has external threads in this example for securing to ball valve assembly 21 (FIG. 1).

In the run-in position of FIG. 15, overshot 25 of connector 24 will receive fish neck 143, with latch assembly 127 between housing internal grooves 125 and fish neck external grooves 145. Latch internal ribs 133 will be located within fish neck external grooves 145. Latch external ribs 131 will be located in the bands or spaces between housing internal grooves 125, which prevents latch internal ribs 133 from moving laterally outward out of fish neck external grooves 145. Latch segment flanges 135 will be in abutment with the upper end of fish neck 143. Housing internal grooves 125 will be axially misaligned with fish neck external grooves 145, with the bands or spaces between housing internal grooves 125 in engagement with the outer sides of latch segment external ribs 131.

Also, in the run-in position, spring 115 (FIG. 12A) will be exerting a downward force on latch piston 117, which will be in the lower or locked position of FIG. 15. Latch piston lugs 123 will be spaced below housing shoulder 124. Tension transfers through connector 24 to support the weight of ball valve assembly 21, packer 19, and lower string 17 (FIG. 1). The load path is through overshot housing shoulder 137 into the lower ends of latch segments 129, and from latch segment internal ribs 133 to fish neck 143. Mandrel seals 113 will seal to a portion of flow passage 119 within fish neck 143.

After packer 19 (FIG. 2) has been set to support the weight of lower string 17, the operator lowers upper string 13 relative to packer 19 and lower string 17. As previously described, this lowering movement causes ball element 23 to move to the closed position. The lowering movement also causes overshot housing 105 to move downward relative to fish neck 143 a short distance, as illustrated in FIG. 16. Latch segments 129 cannot move downward with overshot housing 105 because their flanges 135 will be resting on the upper end of fish neck; thus the lower ends of latch segments 129 will now be above housing internal shoulder 137. The lowering movement of overshot housing 105 relative to fish neck 143 causes spring 115 (FIG. 12A) to compress, resulting in downward facing shoulder 124 in housing 105 abutting the upper ends of flanges 130 of latch segments 129. Mandrel 111 moves downward with housing 105 relative to fish neck 143, placing mandrel seals 113 farther in the sealing portion of flow passage 119 in fish neck 143. In FIG. 16, latch assembly 127 is in a released position with housing grooves 125 radially aligned with fish neck grooves 145. Internal ribs 133 are located in fish neck grooves 145 and external ribs 131 are located partly in housing grooves 125.

The operator then begins pumping fluid down upper string 13 (FIG. 1), which increases the fluid pressure within overshot flow passage 119 due to ball element 23 being closed. The increased pressure communicates through ports 121 into latch piston chamber 122. The increased pressure acts on the lower side of latch piston 117, retaining latch piston 117 in an upper, released position.

The operator then starts lifting upper string 13 (FIG. 1) and overshot 25, as illustrated in FIG. 17. The fluid pressure in flow passage 119 is maintained during an initial part of the upward movement, preventing spring 115 (FIG. 12A) from pushing latch piston 117 downward relative to housing 105 as housing 105 moves upward relative to fishing neck 143. The fluid pressure on latch piston 117 keeps latch assembly 127 fixed axially with housing 105 in the released position as housing 105 moves upward. In the released position, latch external ribs 131 are in housing grooves 125, which allows upward movement of housing 105 relative to fish neck 143. As housing 105 begins to move upward, latch piston lugs 123 cause latch segments 129 to move upward in unison with housing 105.

When mandrel seals 113 move above the sealing portion with flow passage 119 in fish neck 143, the increased fluid pressure in flow passage 119 cannot be maintained. Rather, the fluid being pumped flows out housing external ports 126. At the point mandrel seals 113 lose sealing engagement with fish neck 143, the upper two internal ribs 133 will be located above all of the fish neck grooves 145 on band 144, preventing the other latch segment internal ribs 133 from moving radially inward and re-entering any of the fish neck grooves 145. The operator may cease pumping fluid and continue to lift overshot 25 and latch assembly 127, leaving fish neck 143 down hole.

Referring again to FIG. 3, to retrieve lower string 17, the operator lowers overshot 25 back over inner member 27. Before sliding down over fish neck 143, spring 115 will have pushed latch segments 129 down to the lower position with their lower ends abutting shoulder 137. When the lower ends of latch segments 129 contact the upper end of fish neck upper band 144, continued downward movement of housing 105 compresses spring 115, causing latch segments 129 to be positioned in the upper position with outer ribs 131 entering housing grooves 125. The upper position allows latch segments 129 to slide down fish neck 143 until the upper end of fish neck 143 abuts latch flanges 135. Then upward movement of housing 105 places latch segments 129 in the locked position of FIG. 15. Continued upward pull causes ball valve element 23 to pressure equalize and open. The operator may then release packer 19.

Connector 24 also has features to disconnect overshot 25 from fish neck 143 by rotation in the event a problem develops in maintaining latch assembly 127 in the released position with internal hydraulic fluid pressure. Referring to FIG. 12A, overshot 25 has an optional guide shoe or mule shoe 151 at its lower end. Lower edges 153 curve upward to axially extending grooves 154 that are located 180 degrees apart from each other. A sleeve 155 encloses mules shoe 151 and grooves 154. Referring again to FIG. 12B, a pair of lugs 157 are located opposite each other on inner member 27.

While inserting overshot 25 over inner member 27 mule shoe edges 153 cause an increment of rotation of overshot 25 as lugs 157 align with axial grooves 154. While in the released position of FIG. 16, lugs 157 lock mule shoe 151 with inner member 27 for rotation in unison. Threads 146 between fishing neck 143 and lower adapter 147 (FIG. 12B) are configured to unscrew if upper string 13 (FIG. 1) is rotated in a selected direction. For example, threads 146 may be left hand threads tightened to a much lesser amount that the torque imposed on right hand threads in the upper string 13. To unscrew threads 146, an operator may rotate the upper string 13 in a left hand direction. Lugs 157 also transfers rotational torque from upper string 13 to packer 19 (FIG. 1) to set packer 19.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

The invention claimed is:

1. An apparatus for mounting between an upper string and a lower string of drill pipe to retrieve the upper string after an anchor in the lower string has been set and to block any upward flow of fluid through the lower string after the upper string has been retrieved, comprising:

a connector having a threaded upper end for connection into the upper string, the connector having an outer member that slides over an inner member, the outer member and the inner member having a locked position that transfers tension through the connector to enable the upper and lower strings to be run into the well, the outer member and the inner member having an unlocked position that allows the outer member and the inner member to be released from each other to retrieve the upper string from the lower string after the anchor has been set;

a latch assembly in the connector that places the inner member and the outer member in the unlocked position in response to hydraulic fluid pressure applied to the connector;

a ball valve assembly having an upper portion with a threaded upper end for connection with a lower end of the connector and a lower portion with a threaded lower end for connection with the lower string;

a ball valve element in the ball valve assembly having an open position allowing fluid flow through the lower string and a closed position blocking flow through the lower string; and a ball valve element actuator in the ball valve assembly that rotates the ball valve to the closed position in response in response to the upper portion of the ball valve assembly moving downward relative to the lower portion of the ball valve assembly and rotates the ball valve to the open position in response to the upper portion of the ball valve assembly moving upward relative to the lower portion of the ball valve assembly.

2. The apparatus according to claim 1, wherein:

the outer member and the inner member are movable to the unlocked position without requiring any rotation of the upper end of the connector relative to the lower end of the connector.

3. The apparatus according to claim 1, wherein:

the connector has an axial passage extending through the outer member and the inner member to receive fluid pumped down the upper string;

the latch assembly has a latch piston carried within a latch chamber; and a connector port extends from the axial passage to the latch chamber to apply fluid pressure to the latch piston in response to the fluid being pumped down the upper string to position the latch assembly in the unlocked position.

4. The apparatus according to claim 1, wherein:

the outer member and the inner member of the connector are movable from an extended position during run-in to a contracted position after the anchor has been set; and the latch assembly enables movement from the locked position to the unlocked position only while the outer member and the inner member of the connector are in the contracted position.

5. The apparatus according to claim 1, wherein:

the outer member and the inner member of the connector are movable from an extended position during run-in to a contracted position after the anchor has been set; and wherein the apparatus further comprises:

a set of emergency release threads between the outer member and the inner member that enable the outer member and the inner member to be released from each other in response to rotation of the upper end of the connector relative to the lower end of the connector; and a torque transfer lug that enables rotation of the upper end of the connector relative to the lower end of the connector while the inner member and the outer member are in the contracted position.

6. The apparatus according to claim 1, further comprising:

upper and lower seats that sandwich the ball valve element;

an upper floating piston above the upper seat that urges the upper seat downward against the ball valve element in response to fluid pressure in the ball assembly above the ball element; and a lower floating piston below the lower seat that urges the lower seat upward against the ball valve element in response to fluid pressure in the ball assembly below the ball element.

7. The apparatus according to claim 1, further comprising:

upper and lower seats that sandwich the ball valve element;

an upper floating piston above the upper seat;

an upper exterior port in the ball valve assembly below the upper floating piston that moves the upper floating piston upward relative to the upper seat in response to external fluid pressure applied to the ball valve assembly;

a lower floating piston below the lower seat; and a lower exterior port in the ball valve assembly above the lower floating piston that moves the lower floating piston downward relative to the upper seat in response to external fluid pressure applied to the ball valve assembly.

8. The apparatus according to claim 1, further comprising:

a flow passage extending from an upper end to a lower end of the ball valve assembly;

upper and lower valve seats that are engaged by the ball element, the flow passage extending through the upper and lower valve seats, enabling flow through the flow passage while the ball element is in an open position;

a lower equalizing port extending from the flow passage below the lower valve seat to an exterior portion of the lower valve seat, bypassing an interface between the ball element and the lower valve seat;

an upper equalizing port extending from an exterior portion of the upper valve seat to the flow passage above the upper valve seat, bypassing an interface between the ball element and the upper valve seat; wherein the upper equalizing port opens while the upper portion of the ball valve assembly moves upward relative to the lower portion of the ball valve assembly to equalize pressure in the flow passage below the ball element with above the ball element while the ball element is in the closed position prior to moving the ball element to the open position; and wherein the upper equalizing port closes while the upper portion of the ball valve assembly moves downward relative to the lower portion of the ball valve assembly.

9. The apparatus according to claim 1, further comprising:

upper and lower seats that sandwich the ball valve element; and a threaded seat adjusting ring in engagement with one of the seats for moving said one of the seats adjustably toward and away from the other of the seats in response to selected rotation of the seat adjusting ring.

10. The apparatus according to claim 1, wherein the ball actuator comprises:

a cam assembly in engagement with the ball element that when moved in an upward stroke causes the ball element to change between the closed and the open positions; and a threaded cam member adjusting ring that positions a length of the stroke of the cam assembly in response to selected rotation of the cam member adjusting ring.

11. An apparatus for connecting and releasing an upper string of well pipe and from a lower string of well pipe, comprising:

an inner member having a longitudinal axis;

an outer member having a bore that receives the inner member;

a latch assembly in the bore having a locked position that locks the inner and outer members to each other to enable the upper and lower strings to be run into the well, the latch assembly being axially movable from the locked position to an unlocked position that allows the outer member and the inner member to be released from each other to retrieve the upper string from the lower string;

the latch assembly including a latch piston that enables the latch assembly to be moved axially from the locked position to the unlocked position in response to hydraulic fluid pressure applied to the connector; and a spring that biases the latch assembly toward the locked position, the hydraulic fluid pressure causing the latch piston to overcome the bias of the spring.

12. The apparatus according to claim 11, wherein:

the outer member and the inner member have an extended position and a contracted position relative to each other;

moving the outer member and the inner member to the contracted position places the latch assembly in the unlocked position; and the latch assembly piston retains the latch assembly in the unlocked position while one of the inner and outer members is lifted relative to the other.

13. An apparatus for connecting and releasing an upper string of well pipe and from a lower string of well pipe, comprising:

an inner member having a longitudinal axis;

an outer member having a bore that receives the inner member;

a latch assembly in the bore having a locked position that locks the inner and outer members to each other to enable the upper and lower strings to be run into the well, the latch assembly being axially movable from the locked position to an unlocked position that allows the outer member and the inner member to be released from each other to retrieve the upper string from the lower string;

the latch assembly including a latch piston that enables the latch assembly to be moved axially from the locked position to the unlocked position in response to hydraulic fluid pressure applied to the connector;

a mandrel in the bore of the outer member having an axial passage;

the latch piston being located in an annular space between the mandrel and a side wall of the bore of the outer member; and a latch piston port extending laterally through the mandrel for delivering hydraulic fluid pressure from the axial passage into the annular space to apply to the latch piston.

14. An apparatus for connecting and releasing an upper string of well pipe and from a lower string of well pipe, comprising:

an inner member having a longitudinal axis;

an outer member having a bore that receives the inner member;

a latch assembly in the bore having a locked position that locks the inner and outer members to each other to enable the upper and lower strings to be run into the well, the latch assembly being axially movable from the locked position to an unlocked position that allows the outer member and the inner member to be released from each other to retrieve the upper string from the lower string;

the latch assembly including a latch piston that enables the latch assembly to be moved axially from the locked position to the unlocked position in response to hydraulic fluid pressure applied to the connector; wherein the bore of the outer member has an side wall with a plurality of axially spaced apart outer member grooves;

the inner member has an exterior surface with a plurality of axially spaced apart inner member grooves;

the latch assembly has a plurality of outer ribs and a plurality of inner ribs;

the inner ribs are located in the inner member grooves and the outer ribs positioned axially between the outer member grooves while the latch assembly is in a locked position; and the outer ribs are located in the outer member grooves while the latch assembly is in the unlocked position.

15. An apparatus for connecting and releasing an upper string of well pipe and from a lower string of well pipe, comprising:

an inner member having a longitudinal axis;

an outer member having a bore that receives the inner member;

a latch assembly in the bore having a locked position that locks the inner and outer members to each other to enable the upper and lower strings to be run into the well, the latch assembly being axially movable from the locked position to an unlocked position that allows the outer member and the inner member to be released from each other to retrieve the upper string from the lower string;

the latch assembly including a latch piston that enables the latch assembly to be moved axially from the locked position to the unlocked position in response to hydraulic fluid pressure applied to the connector;

a set of emergency release threads between the outer member and the inner member that enable the outer member and the inner member to be released from each other in response to rotation of the outer member and the inner member relative to each other; and a torque transfer lug that enables rotation of the outer and inner members relative to each other while the inner member and the outer member are in the contracted position.

16. An apparatus for mounting between an upper string and a lower string of drill pipe to block upward flow of fluid through the drill pipe after the lower string has been anchored and the upper string retrieved, comprising:

a ball valve assembly having an axis, an axial flow passage, an upper portion, an intermediate portion, and a lower portion, the upper portion and the lower portion being axially movable relative to each other and to the intermediate portion;

upper and lower seats in the intermediate portion within the flow passage;

a ball valve element located between the seats, the ball valve element having an open position allowing fluid flow through the flow passage and a closed position blocking flow through the flow passage;

a ball valve element actuator in the intermediate portion that rotates the ball valve to the closed position in response in response to the intermediate portion moving downward relative to the lower portion and rotates the ball valve to the open position in response to the intermediate portion moving upward relative to the lower portion;

a lower equalizing port extending from the flow passage below the lower seat to an exterior portion of the lower seat, bypassing an interface between the ball element and the lower seat;

an upper equalizing port extending from an exterior portion of the upper seat to the flow passage above the upper seat, bypassing interface between the ball element and the upper seat; wherein the upper equalizing port opens while the upper portion of the ball valve assembly moves upward relative to the intermediate portion of the ball valve assembly to equalize pressure in the flow passage below the ball element with above the ball element while the ball element is in the closed position and prior to the intermediate portion moving upward relative to the lower portion; and the upper equalizing port closes while the upper portion moves downward relative to the intermediate portion of the ball valve assembly.

17. The apparatus according to claim 16, further comprising:

an upper floating piston above the upper seat that urges the upper seat downward against the ball element in response to fluid pressure in the flow passage above the ball element; and a lower floating piston below the lower seat that urges the lower seat upward against the ball element in response to fluid pressure in the flow passage below the ball element.

18. The apparatus according to claim 17, further comprising:

an upper exterior port in the ball valve assembly below the upper floating piston that moves the upper floating piston upward relative to the upper seat in response to external fluid pressure applied to the ball valve assembly; and a lower exterior port in the ball valve assembly above the lower floating piston that moves the lower floating piston downward relative to the upper seat in response to external fluid pressure applied to the ball valve assembly.

19. The apparatus according to claim 16, further comprising:

a threaded seat adjusting ring in engagement with one of the seats for moving said one of the seats adjustably toward and away from the other of the seats in response to selected rotation of the seat adjusting ring.

* * * * *